United States Patent [19]

Mäkipirtti et al.

[11] 4,308,058

[45] Dec. 29, 1981

[54] PROCESS FOR THE OXIDATION OF MOLTEN LOW-IRON METAL MATTE TO PRODUCE RAW METAL

[75] Inventors: Simo A. I. Mäkipirtti, Nakkila; Launo L. Lilja, Pori; Mauri J. Peuralinna, Pori; Valto J. Mäkitalo, Pori, all of Finland

[73] Assignee: Outokumpu Oy, Helsinki, Finland

[21] Appl. No.: 160,837

[22] Filed: Jun. 18, 1980

[30] Foreign Application Priority Data

Jun. 20, 1979 [FI] Finland ..... 791965

[51] Int. Cl.[3] ..... C22B 13/06

[52] U.S. Cl. ..... 75/76; 75/78

[58] Field of Search ..... 75/76, 78

[56] References Cited

U.S. PATENT DOCUMENTS 4,073,646 2/1978 Kryczun ..... 75/76

*Primary Examiner*—P. D. Rosenberg

*Attorney, Agent, or Firm*—Brooks, Haidt, Haffner & Delahunty

[57] ABSTRACT

A molten metal matte low in iron is oxidized by blasting oxygen or air into the metal layer to produce raw metal.

4 Claims, 4 Drawing Figures

System Cu-S-O
Fig. 2A
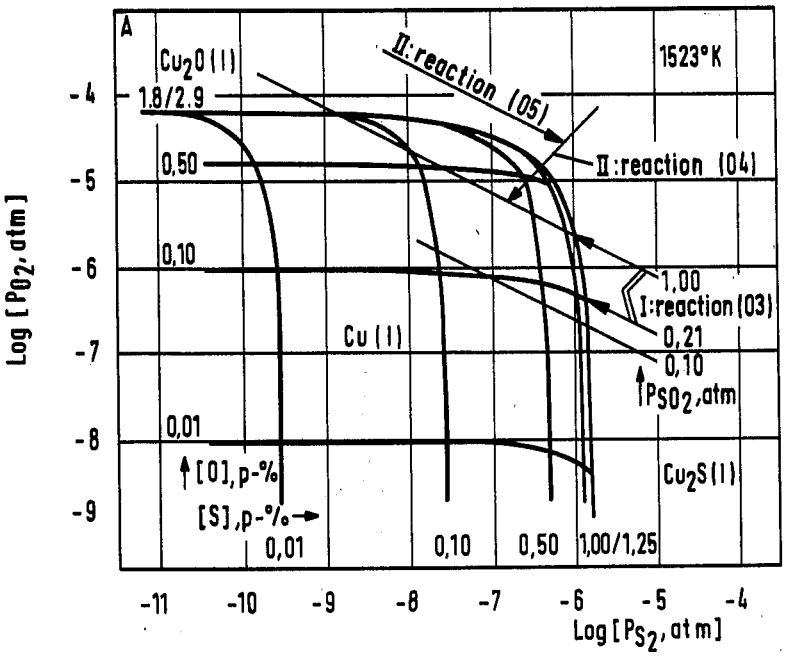
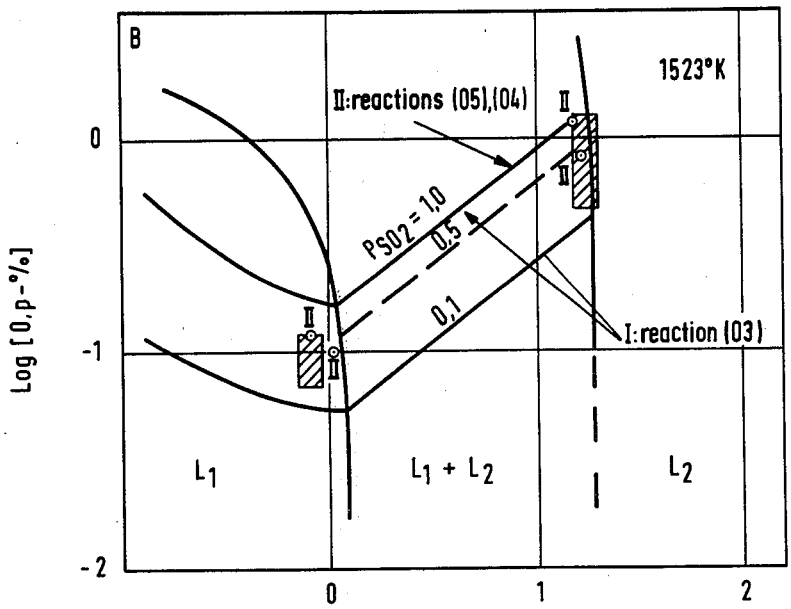
Fig. 2B

PROCESS FOR THE OXIDATION OF MOLTEN LOW-IRON METAL MATTE TO PRODUCE RAW METAL

BACKGROUND OF THE INVENTION

The present invention relates to a process for the oxidation of molten low-iron metal mattes, e.g. copper, copper-nickel or lead mattes, by air blasting or oxygen-enriched air blasting in order to produce raw metal, and it relates in particular to a process for the refining of low-iron copper and copper-nickel sulfide mattes to produce raw metal or converter matte. The process according to the invention can be carried out in converters known per se or directly in, for example, a flash smelting furnace.

Before the invention of the converter technique, the sulfide ores of copper were smelted to produce high-grade sulfide mattes. The mattes were roasted, either in part or completely, to oxides. The copper oxide was reacted at a sufficient temperature either with matte sulfide or iron sulfide, whereby raw copper and sulfur dioxide were obtained as products. The process used, with its numerous roasting and reduction operations, was both slow and expensive.

In 1856, Sir Henry Bessemer introduced his process for producing steel from pig iron by through-blast conversion. During the same and subsequent decades, several attempts were made to blast copper sulfide mattes in a Bessemer converter. However, the enthusiasm for the experiments cooled rapidly, when it was observed that the forming metallic copper solidified immediately and clogged the tuyeres. The results obtained led to the assumption that the Bessemer process was impossible to apply to the treatment of copper matte.

In 1880, The Frenchmen Pierre Manhés and Paul David at the smelting plant of Verdennes began to experiment with the blasting of copper matte in a small steel converter, completely ignorant of the previously encountered insurmountable difficulties. They succeeded in blasting, without problems, a high-grade $Cu_2S$ matte from low-grade copper matte (25–30% by weight Cu). In attempts at blasting $Cu_2S$ matte to produce copper the result was usually vigorous boiling of the charge, and part of the charge flying out of the apparatus (i.e. the known foaming phenomenon occurring in the blasting of high-grade matte in the presence of slag, and consequences of this phenomenon). Attempts at blasting to produce metal ended up in the clogging of the tuyères also in the said experiments. Manhés and David noticed, however, that the main reason for the solidification of the copper and the clogging of the tuyères below the metal surface was the cooling effect of the large oxidizing air quantity on the metal melt separating from the sulfide melt owing to the solubility gap and settling at the bottom of the furnace. For this reason, they replaced the vertical tuyeres with horizontal ones situated at a few inches above the furnace floor. By using horizontal tuyères and by removing the slag phase from the system, it was finally possible to produce raw metal by blasting copper sulfide matte. One year after the commencing of the experiments, the new process was already applied on a technical scale.

However, the impurity of the metal produced often constituted a problem in carrying out the process. This was due to the fact that, after the oxidation of the iron, the position of the tuyères was at times too high in relation to the matte surface. This difficulty was first overcome by transferring the high-grade copper matte to another converter for blasting, and then it was possible to control this tuyere height by regulating the feed rate. In 1885 Paul David took into use a horizontal, cylindrical and axially tiltable converter, and then it was easy to adjust the height of the tuyeres in relation to the matte surface by tilting the converter.

Attempts at converting matte sulfide by means of a horizontal cylinder converter having an alkali lining were successful in 1909 (Pierce and Smith in Baltimore).

Since this rapid development work, the basic principles of both the matte sulfide blasting technique and the apparatus nowadays known as the Pierce-Smith converter have remained the same for nearly 100 years.

In recent decades, the development work on the Pierce-Smith converter has focused on increasing the capacity [J. Metals, 20, 1968, 39–45; Trans AIME, 245, 1969, 2425–2433; Extractive Metallurgy of Copper, Pergamon 1976, 177–203], on automating the air feed systems and tuyère sweeping, increasing the concentration of sulfur dioxide in the outlet gases, and improving the recovery of these gases [Tsvetnye Metally, 13, 1972, 15–18; Advances in Extractive Metallurgy, London 1967, 333—343], as well as on shortening the time periods required by charging and slag discharge and on optimizing the operating conditions [Tsvetnye Metally, 16, 1975, 20–21, 24, 26–27; 5, 1978, 41–45, Automatica, 5, 1969, 801–810, J. Metals, 20, 1968, 43–54; Operating Metallurgy Conference, Met. Soc. AIME, 1966, Philadelphia]. Nowadays, the most conventional size of a Pierce-Smith converter is $4\times9$ ($\pm20\%$) m and capacity approx. 100–200 t copper a day. The tuyeres are situated approx. 20–30 cm below the melt surface. The number of tuyeres placed in one converter in a row parallel to the side line is 30–50, and their nozzle diameter is 40–80 mm.

The adoption of oxygen-enriched air [J. Metals, 14, 1962, 641–643, Erzmetall, 19, 1966, 609–614] has improved the possibilities for the development of conversion processes and apparatus. The use of oxygen has increased apparatus capacities primarily because of shorter blasting periods. Since the conversion process is autogenic as regards thermal economy even when air is used, the use of oxygen causes an increased need for cooling in the system (also apparatus lining problems). The cooling agent adopted in addition to the conventional feed of scrap is the feed of concentrate [Tsvetnye Metally, 10, 1968, 10, 1968, 47–54; 10, 1968, 47–54; 10, 39–42; 12, 1970, 6–7; 14, 1972, 4–6]. The use of oxygen in the blasting air has also made it possible to convert concentrate directly to metal [J. Metals, 13, 1961, 820–824; 21, 1969, 23–29]. Horizontal cylinder furnaces have been developed for direct concentrate conversion, and when necessary, these furnaces are divided into several functional zones for slag and metal blasting, slag refining, etc. [Canad. Pat. 758.020, U.S. Pat. No. 3,832,163, U.S. Pat. No. 3,326,671]. However, direct conversion of concentrates in industrial use has not spread rapidly since, owing to the use of oxygen, the problems of wear of the apparatus are considerable.

Even though attempts have been made to develop the tuyere apparatus to be applicable to the use of oxygen-enriched air to oxygen (e.g. U.S. Pat. No. 3,990,890), there are surface blast converters applicable to the use of pure oxygen being developed along with the technologically dominating Pierce-Smith type converter [J.

Metals, 16, 1964, 416–420; 21, 1969, 35–45, Annual Meeting of the AIME, Dallas, 1974, U.S. Pat. No. 3,069,254]. When surface blasting is used, the oxygen feed pipe nozzles used can be Laval nozzles (the nozzle is not destroyed since it is situated above the melt surface) and thereby great advantages can be gained. Surface blasting methods usually require slag-free metallization of low-iron high-grade copper and nickel sulfide mattes.

On a technical scale it has also been possible (at least partly) to surface blast vertically medium-grade (60–65% by weight Cu) copper sulfide matte [The Future of Copper Pyrometallurgy. The Chilean Inst. Min. Engrs. Santiago, 1974, 107–119].

The object of the present invention is, therefore, to provide a process for the oxidation of molten, low-iron metal matte to raw metal, eliminating the disadvantages involved in the prior known processes mentioned above.

SUMMARY OF THE INVENTION

According to the invention, air, oxygen-enriched air or oxygen is blasted below the matte layer directly into the raw metal melt, or bottom melt.

DESCRIPTION OF THE PREFERRED EMBODIMENTS

Figure 1A:
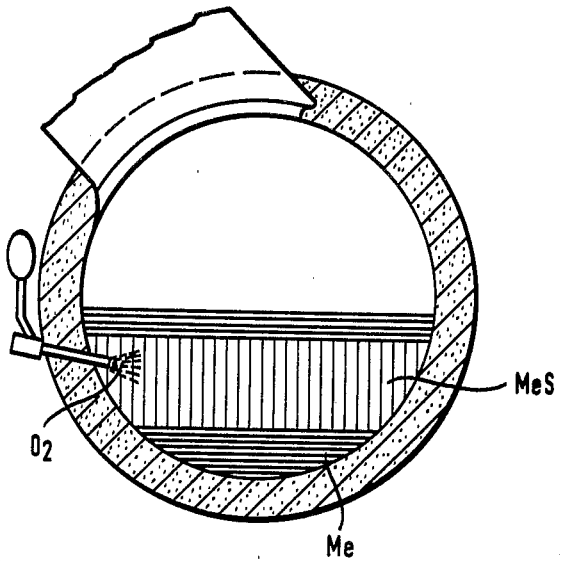
FIG. 1A depicts a cross sectional side elevation of a prior known Pierce-Smith converter.

According to a preferred embodiment of the invention, oxygen-enriched air is fed, by means of a vertical feed pipe or feed pipes provided with cooling equipment, through molten slag and matte layers in the furnace into a raw metal melt (bottom melt) already situated below them, in such a manner that, by means of a suitable nozzle attached to the feed pipe the oxidizing gas is guided in a horizontal direction. As regards the oxidizing air, the operation takes place in the feed pipe preferably within a supercritical pressure range, in which case, owing to the increasing density of the melt, the gas amount penetrating the melt also increases to a high level compared with the gas amount fed at conventional pressure. The temperature of the melts is controlled by regulating the oxygen enrichment of the oxidizing gas. When carrying out the process, the thickness of the bottom metal layer is maintained practically constant (blister is withdrawn from the system at a rate corresponding to its formation, by means of, for example, the Arutz sifon), and then the position of the oxidizing gas feed nozzles can also be maintained constant in relation to the bottom metal surface.

In order to prevent the foaming of the slag on top of the matte layer, preferably a melt is blasted which contains iron at minimum 0,5% by weight per each cm of the matte layer in the vertical direction.

The new process is based on the following observations, among others:

The oxygen absorption capacity of molten copper is high, and this phenomenon is very rapid, compared with melt sulfides. Combined with the highly effective mixing produced by the high-velocity and expansive oxidizing gas (the $Cu_2O(l)$ layer surrounding a bubble braks and no barrier to diffusion is produced), large quantities of oxygen can be fed into the copper melt, virtually at the theoretical efficiency, with the aid of this phenomenon.

The copper oxidule produced in the bottom melt rises to the surface of the metal melt, becomes evenly mixed within the phase boundary between the matte sulfide and the bottom metal, and in this case the oxide-sulfide conversion occurs rapidly and evenly. When the oxygen leaves the blasting gas, the remaining nitrogen amount (behaving inertly in relation to the melt) leaves the melt independently. The sulfur dioxide obtained as a product of the conversion reactions nucleates evenly within the phase boundary and rises through the sulfide melt as small bubbles, without forming an uninterrupted flow battery and without causing boiling or foaming in the matte and/or slag phase.

It should be noted that during the oxidation of the bottom metal, products of oxidation of the impurities present in the raw metal also dissolve in the copper oxidule, and these products of oxidation decrease the density of the molten oxidule. The density of the oxidule of stoichiometric copper is only slightly lower than the density of sulfide melt, and so the velocity of rising of the oxidule in molten sulfide is very advantageous in relation to the velocity of the conversion reactions.

According to measurements, approximately threefold copper formation rate has been achieved by the process according to the invention, as compared with conventional matte conversion. Firstly, this is obviously due to the fact that the reaction velocity in a conversion based on direct contact of the constituents is far higher than in a matte conversion based on gas diffusion. Secondly, in conventional matte blasting, the efficiency of the use of oxygen remains low owing to changes in the thickness of the matte bed and also on the formation of a flow battery caused by the constant gas volume ($O_2$ is replaced by $SO_2$) and by the increasing bubble size, the flow battery being nearly inert in relation to its environment.

When the process according to the invention is carried out, the oxidation or reduction of the impurities present in the sulfide phase takes place under the effect of the copper oxidule. There are, however, slight differences in the distribution values and concentrations of the impurities, as compared with the values of conventional direct sulfide conversion. Even though the concentrations of the impurity constituents, e.g. nickel and lead, decrease in the course of the conversion, their distribution values as regards the raw metal and the sulfide melt change anomalously. The distribution value of nickel drops below and that of lead respectively rises above the values corresponding to an equilibrium. The change in the distribution is obviously due to the method of conversion and is controlled, at least in part, by the density of the impurity metals and their compounds.

The process according to the invention can be used advantageously in terms of both process and heat technology in conjunction with, for example, a basic smelting unit, when carrying out, for example, the blister production process according to U.S. Pat. No. 4,139,371 hereby incorporated by reference.

The conversion process according to the invention can thus be used advantageously for the metallization of low-iron copper or copper-nickel mattes.

The conversion can be represented by the following reactions, for example:

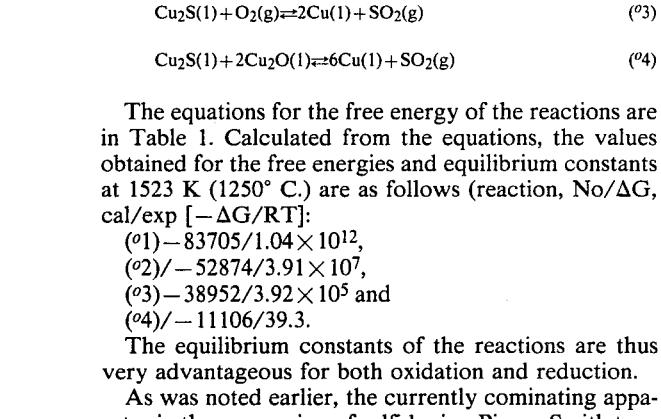

$$FeS(1)+1\tfrac{1}{2}O_2(g)\rightleftarrows FeO(1)+SO_2(g) \quad (^o1)$$

$$Cu_2S(1)+1\tfrac{1}{2}O_2(g)\rightleftarrows Cu_2O(1)+SO_2(g) \quad (^o2)$$

$$Cu_2S(1)+O_2(g)\rightleftarrows 2Cu(1)+SO_2(g) \quad (^o3)$$

$$Cu_2S(1)+2Cu_2O(1)\rightleftarrows 6Cu(1)+SO_2(g) \quad (^o4)$$

The equations for the free energy of the reactions are in Table 1. Calculated from the equations, the values obtained for the free energies and equilibrium constants at 1523 K (1250° C.) are as follows (reaction, No/ΔG, cal/exp [−ΔG/RT]:

($^o$1)−83705/1.04×10$^{12}$,
($^o$2)/−52874/3.91×10$^7$,
($^o$3)−38952/3.92×10$^5$ and
($^o$4)/−11106/39.3.

The equilibrium constants of the reactions are thus very advantageous for both oxidation and reduction.

As was noted earlier, the currently cominating apparatus in the conversion of sulfides is a Pierce-Smith type cylinder converter, tippable axially along the horizontal plane and equipped with alkali lining. The oxidizing-gas feed nozzles, which penetrate the cylinder wall and are in a row parallel to the side line, direct the gas flow to below the surface of the sulfide melt, as shown in FIG. 1A.

Figure 1B:
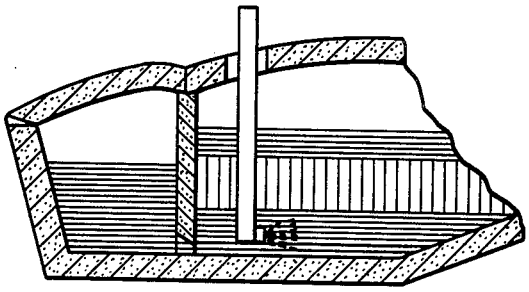
FIG. 1B depicts a cross sectional side elevation of a suspension furnace intended for carrying out the process according to the invention, provided with a cooled steel pipe which extends inside the metal melt, and FIGS. 2A & B depict the stability ranges of the system Cu-S-O and the corresponding concentration values.

When carrying out the process according to the invention, advantageously a steel pipe is used which is equipped with cooling and outside lining and, at its lower end, with a horizontally operating nozzle for the blasting of oxygen-enriched air. The feed-pipe can be installed directly in the basic smelting unit for ore or concentrate, e.g. a suspension furnace or a separate conversion vessel. When carrying out the process it is required that the oxidizing gas is fed to the inside of the metal melt, and so there must be a so-called "bottom metal melt" in the apparatus. One suitable apparatus is shown in FIG. 1B.

In the process according to the invention, the conversion reactions are as follows:

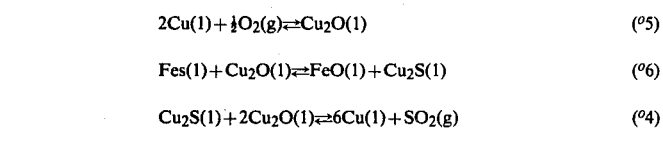

$$2Cu(1)+\tfrac{1}{2}O_2(g)\rightleftarrows Cu_2O(1) \quad (^o5)$$

$$Fes(1)+Cu_2O(1)\rightleftarrows FeO(1)+Cu_2S(1) \quad (^o6)$$

$$Cu_2S(1)+2Cu_2O(1)\rightleftarrows 6Cu(1)+SO_2(g) \quad (^o4)$$

The values of the free energies and equilibrium constants of the reactions (Table 1) are as follows:

($^o$5)/−13923/99.8,
($^o$6)/−30828/2.67×10$^4$ and
($^o$4)/−11106/39.3.

Since the sulfide mattes within the scope of the process are rich in valuable metals, the need for slag blasting of iron (Reaction ($^o$6) is low (initial sulfide: 65–81% by weight Cu, 12-0.5% by weight Fe). The wüstite produced during the slag blasting is in equilibrium with magnetite.

The difference between the process according to the invention and the conventional processes can be seen in the stability ranges of the system Cu-S-O and in the respective concentration values given in FIGS. 2A and 2B.

In FIG. 2A, the stability field of the system Cu-S-O is shown as a function of the oxygen and sulfur pressures at 1250° C. In conventional matte oxidation, the raw metal is approached from the direction of the sulfide ($Cu_2S$) (Figure: I: $Cu_2S(1)+O_2(g)\rightleftarrows 2Cu(1)+SO_2(g)$. The oxidation sulfide corresponding to a $P_{SO2}$ isobar of one atmosphere, and the metal phase, are indicated in the figure. When air or oxygen-enriched air is used as the oxidant, the reaction follows the $SO_2$ isobar of a lower pressure, and the oxygen and sulfur isoconcentration curves of the product metal are thus crossed at lower concentrations than previously, depending on the conditions. In the process according to the invention, the oxidation of the bottom metal (Reaction ($^o$5)) is carried out first. The obtained copper oxidule reacts, when pure ($a_{CU2O}\sim 1$), with chalcocite ($a_{Cu2S}\sim 1$) according to Reaction ($^o$4).

According to Equilibrium Diagram 2A (Figure: path II), the process according to the invention always ends up at isobar $P_{SO2}=1.0$ atm as regards the raw metal. When the oxidation is performed using oxygen-enriched air, the first reaction product is always a $Cu_2O$ phase and a nitrogen-argon gas phase. The nitrogen gas leaves the system at a limited cross sectional surface of melt (dispersing flow battery) as does the sulfur dioxide produced during the second reaction stage. The copper oxidule rises from the raw copper and is distributed, under the effect of flows, throughout the phase boundary $Cu_2S$-Cu, and then sulfur dioxide rises evenly throughout the cross sectional area of the melt.

At 1250° C. sulfur dioxide ($a_{Cu2S}=a_{Cu2O}=1$) corresponding to Contact Reaction ($^o$4) corresponds to a pressure value of $P_{SO2}=39$ atm.

The concentrations of sulfur and oxygen corresponding to the stability field of FIG. 2A have been calculated and are shown in FIG. 2B. The composition ranges corresponding to the conventional matte sulfide oxidation process within the various phase ranges follow the isobar range $P_{SO}=0.1$–$1.0$. In the process according to the invention, the concentration ranges correspond to an isobar of $P_{SO2}=1.00$ (or $P_{SO2}>1.00$ atm).

The oxygen concentration and the oxygen dissolution rate of both sulfide matte and raw metal are of great importance in conversion. From the equilibrium solubility diagram (FIG. 2B) it can be seen that the oxygen solubility of $Cu_2S_x$ melt decreases with increasing metallization.

The solubility of oxygen in the copper sulfide melt is obtained as a function of the sulfur dioxide pressure, using the equation [Inst. of Min. Met. Bull, 86, 1977, C88/91] [O, % by weight]=27.57 [$P_{SO2}$·atm]$^{\frac{1}{2}}$exp [2330.0/T-4.5128].

The solubility of oxygen in $Cu_2S$ melt obtained at 1250° C. at sulfur dioxide partial pressures of $P_{SO2}=0.21$ and 1.00 atm are respectively [O]=0.64 and 1.40% by weight O.

At 1250° C. and at an oxygen partial pressure of $P_{O2}=0.23$ atm (linear relation: pressure-velocity) the value obtained for the rate of the dissolution of the oxygen in $Cu_2S$ melt in a static system is $m=2.42\times 10^{-3}$ kg O/m$^2$·s[Izv. Akad. Nauk., Met. 1978, 5, 29–35]. When the gas diffusion ($O_2$-$SO_2$-Ar system) determines the dissolution rate, the value obtained for the dissolution rate within a diffusion distance of the centimeter is $m=2.05\times10^{-3}$ kg $O/m^2\cdot s$ [Met. Trans. 3, 1972, 2187–2193]. The values are thus in the same order of magnitude (an adsorptive solubility occurring at the beginning of dissolving at a low rate was observed in the previous measurement).

When $Cu_2S$ melt is surface blasted using air as the oxidant, the oxygen dissolution rate obtained for a system with good mixing at 1300° C. is $m=1.75\times10^{-2}$ kg $O/m^2\cdot s$ [Laval nozzle: spray force$=129\times10^{-3}$ $kg/m\cdot s^2$, air velocity=338 m/s, oxygen efficiency=55%; Metallwiss. u. Technik, 25, 1471, 1245–1251], which is thus about 8 times greater than the static rate. In the conversion process according to the invention, the oxidation of raw copper is performed as a process stage preceeding Conversion Reaction ($4^o$).

In the system copper-oxygen there is a solubility gap between the copper melt and the copper-containing copper-1-oxide melt. The oxygen concentrations at the limits of the solubility gap are at the opening temperature of the gap, 1220° C., those corresponding to values (% by weight) 2.55 and 10.20 and at 1300° C. those corresponding to values 3.96 and 9.17. At 1340° C. (~6.4% by weight O), the solubility gap closes and the melt becomes homogeneous. During the oxidation of copper it is to be expected that within the solubility gap a barrier to diffusion is formed, due to the oxide melt, and this barrier has an adverse effect on the processing.

It can be shown experimentally that, during the first stage, within a few milliseconds, an oxygen amount linear in relation to the pressure is formed. This amount is dependent only on the surface area of the melt and not on its quantity (1250° C., $dv/dA=0.2205$ $Nm^3/m^2$). During the second stage of oxidation, the dissolution rate of oxygen becomes a function of not only the surface area but also of the square root of the oxygen pressure. In this case the dissolution of oxygen occurs as diffusion transfer via the copper oxidule layer [Met. Trans. 9B, 1978, 129–137]. In terms of conversion, the low volume of the oxidizing-gas bubbles is advantageous.

When gas diffusion determines the rate of oxygen dissolution in the copper melt, the value obtained for the dissolution rate of oxygen at 1250° C. and oxygen pressure of $P_{O2}=0.21$ within a diffusion distance of one centimeter is $m=1.81\times10^{-3}$ kg $O/m^2\cdot s$.

When copper was oxidized by surface blasting air via a Laval nozzle [conditions the same as in sulfide blasting, Metall, 25, 1971], the density obtained for the oxygen flow taken up by the melt was $m=4.0\times10^{-2}$ kg $O/m^2\cdot s$. The barrier to oxygen absorption was in this case the slow diffusion of the gas phase oxygen in nitrogen. It should be noted that the obtained oxygen dissolution rate is 35-fold compared with a static system, and thus the melt turbulences produced by the spray disperse the $Cu_2O$ melt films which constitute a melt barrier. It should be mentioned that the oxygen flow taken up by sulfide under the same conditions was about 2.3 times lower.

In order to determine the rate of sulfide conversion in the process according to the invention, oxidation experiments were carried out as regards both sulfide and raw metal phases. In sulfide conversion, the operation takes place according to Sum Reaction ($3^o$), and when oxidation of the raw metal (Reaction ($^o5$)) precedes the conversion the operation takes place according to Reaction ($^o4$).

The experiment series was carried out using a 500 kVA light arc furnace equipped with a cover. Low-iron converter matte from a conventional conversion process was smelted in the furnace, the electrodes were removed from the melt and the oxidizing-air feed pipe was lowered into the melt. It was possible to adjust the position of the feed pipe in the vertical direction, and thereby the horizontally blasting gas nozzle could be positioned as desired in relation to the matte and metal surfaces. The slag-metal interfaces were observed during the conversion by determining, by means of a pipe sector probe, the interfaces between the melts in the vertical direction, at five-centimeter distances, and the analyses of the melt surfaces as a function of the level. Interface measurements were carried out indirectly from outside the furnace by means of a probe working on the basis of electromagnetic induction.

The quantity of oxidizing gas and the oxygen potential could be regarded freely. Supercritical pressure conditions were maintained in the oxidizing-gas feed pipe. Thereby the rate of oxidizing gas varied within the range 1500–5000 $kg/m^2\cdot s$ per nozzle.

It was possible to observe sulfide conversion according to the invention and conventional sulfide conversion as successive phenomena during the same experiment, whereby the differences could be distinguished clearly. The differences between the conversion processes were also observed in separate experiment series, whereby the effect of the matte surface level and the foaming phenomena of the matte and the slag could also be checked.

In a typical experiment series the conditions were as follows:

Rate of oxidizing gas: 1500 $kg/m^2\cdot s$
Temperature of oxidizing gas: 300 K.
Oxygen content in oxidizing gas: 50 %
Temperature of melt: 1523 (+50) K The feed and product analyses of the experiment series corresponded on the average to the values of Table 6. By indicating the quantities of material the surface level of the total material and the surface level of the raw metal surface by M[kg], H[cm] and h[cm], the conversion balances obtained on the basis of the analysis values of Table 6 are:

Matte level (t=0 min): $H_o=2.3108\times10^{-2}$ Mo
Metal level (t=0 min): $h_o=1.5955\times10^{-2}$ Mo, Me
Level of total material (t=t min): $H=H_o-0.9096$ h
Matte quantity: $M=-82.6379$ h
Metal quantity: $M=62.6733$ h
Slag quantity: $M=5.4640$ h
Copper oxidule quantity: $M=147.2472$ h
Sulfur dioxide quantity: $M=30.9669$ h
Oxygen quantity: $M=16.4664$ h The experimentally determined rise in the raw metal surface level was, within the limits of the measuring precision, practically a linear function of the time. However, anomalies appeared in the level of total material, expecially in connection with direct sulfide blasting, where the level of total material rose a few centimeters at the beginning of the blast and then remained at a constant level, although blister was produced simultaneously. The rate of change in the surface level of the forming raw metal obtained under the experimental conditions under discussion, using direct sulfide conversion, was $dh/dt=0.088$ cm/min, and respectively, when raw metal oxidation preceded the conversion the rate was $dh/dt=0.250$ cm/min. In the process according to the invention, the formation of blister was thus 2.86-fold compared with the conventional. With the apparatus used, the conversion rate obtained by the new process was, depending on the rate of blasting air and its oxygen content, M=12.5–18.5 kg/min and in direct sulfide conversion it was M=3.1–7.5 kg/min. In conventional conversion according to Sum Reaction (3°), the slow $SO_2$-$O_2$ countercurrent diffusion of the oxidizing gas phase bubbles in nitrogen obviously decreases the rate. In the process according to the invention, Reaction (°5) must determine the total rate and Reaction (°4) must, at least as a contact reaction under the prevailing conditions, be very rapid. The obtained result is in very good harmony with the previously discussed oxygen dissolution rates and solubilites.

In the process according to the invention, both the real and quantitative velocity of the oxidizing gas obviously causes a strong mixing between the oxide-sulfide reaction components. The mixing effect can also be seen in the analyses of the raw copper obtained (oxygen content is low and sulfur content high, although the oxidation takes place in the metal melt). In conventional conversion technology using a Pierce-Smith converter, the rate of air to be used in copper blasting is in the order of 650 $Nm^3$/min. The number of nozzles being 48 and the nozzle diameter being 1 ¾", the rate of air obtained per nozzle surface area is 187 kg/s·$m^2$ [J. Metals, 1968, 34–45]. In the process according to the invention, supercritical pressure conditions are applied in the gas pipe, and thereby gas is fed into the system at rates ten times the above value per nozzle. The mixing effect of the gas flow can also be assumed to be high in this case.

In the process according to the invention, the efficiency regarding the oxidizing agent regularly proved to be over 100% (matte level 5–45 cm). In the conversion of low-grade sulfide matte this is very common, since corresponding to the high FeS activities in the sulfide matte, an equilibrium mixture $S_2$-$SO_2$-$N_2$ is formed instead of sulfur dioxide. At a high temperature, in the presence of metal and in a sulfide melt having a low oxygen content, the formation of sulfur monoxide is thermodynamically possible (although in a low quantity). When studying the kinetics of copper oxide-sulfide conversion [Met. Trans. 5, 1974, 2501–2506], it has been assumed, on the basis of measurements, that sulfur monoxide is formed as the first component, which determines the rate of conversion (in spite of the very high reactivity of sulfur monoxide). It was not possible to study this question in the experiment series performed.

It must be noted that when carrying out the $Cu_2O$/-$Cu_2S$ conversion, the sulfide phase can, when so desired, be spent without the occurrence of the slag-matte-blister foaming phenomenon. This is most likely due to the fact that in the oxidation of the raw metal, the volume of the original gas phase changes (oxygen leaves the gas phase) and the remaining oxygen behaves inertly in relation to the melt phases. In this case, the bubble size of the gas phase also becomes independent of the nozzle diameter. The formed sulfur dioxide does not follow the flow battery (as in the conventional process) but nucleates and discharges over a wide area in the form of bubbles of a suitable size. In direct sulfide blasting the splashing of the slag and the flying out of the products from the furnace, common when using low rates of air, expecially if both the viscosity and the surface tension of the slag are not under continuous and careful control.

When oxidation of raw metal preceded the conversion, the analysis of the results differed slightly from that of direct conversion of sulfide.

In the conversion according to the invention, the variation ranges (% by weight) of the analysis values of the sulfide phases were respectively as follows: 0.10–0.14 O, 0.8–0.9 S, >0.1 Fe, and 1.1–1.4 O, 15.5–18.0 S, 0.2–0.3 Fe. In direct sulfide conversion, the ranges of the analyses of the phases were as follows: 0.09–0.10 O, 0.8–1.1 S, 0.1–0.2 Fe, and 1.2 O, 16.0–17.0 S, 0.4–0.7 Fe. The reasons for these analyses ranges have already been discussed with reference to FIG. 2B.

The complied heat balance calculations corresponding to the example experiment series are shown in Tables 2, 3, 4 and 6. The balances were calculated for the conversion process according to the invention. The total balance of Table 2 is also applicable to direct sulfide conversion, provided that the conversion period (in this apparatus-specific case) is taken as being 2.8-fold, and the bottom metal is excluded. The highly exothermal nature of the total process of each conversion method can be observed from the substitution values in Table 6. Tables 3 and 4 show the calculated heat balances of the bottom metal oxidation and the oxide-sulfide conversion, respectively. It can be observed from the values in Table 6 that the phase boundary conversion is nearly neutral, and almost all of the exothermal heat is produced by the oxidation of the raw metal. This heat amount distribution according to the invention is of great technical importance. When the process is applied in conjunction with a basic smelting apparatus, the heat of conversion can, by transmission of a good conductor, i.e. molten copper, be transferred to compensate for the heat losses of the large furnace unit. There is no risk of the bottom melt solidifying in this system, and, furthermore, there is little need for sweeping the oxidizing-gas nozzle. Activated by the sufficiently high temperature of the phase boundary, the rate of the oxidesulfide conversion, which is neutral in terms of heat economy, also remains high.

EXAMPLE

The application of the invention in connection with a basic smelting unit which produces sulfide matte directly from concentrate, in this case a flash smelting furnace, is discussed. The concentrate is oxidized in the conventional manner in the furnace reaction shaft, in suspened state, to a product corresponding to high-grade sulfide matte (70–80% by weight Cu). Suspension reduction in the reaction shaft or conventional reduction in the lower furnace (e.g. SFP No. 45866 and/or 47380) can be used in order to use a low concentration of ferric iron in the product slag phase. The temperatures of the sulfide matte and the slag phase, forming in the lower furnace chamber of the basic smelting furnace, are 1250° C. and 1300° C., respectively. The product analyses of the basic smelting stage, corresponding to the example are given in Table 7. The product matte phase of the smelting forms the feed matte phase of the conversion.

According to the process, the bottom metal, which is below the slag and sulfide phases, is oxidized by means of oxygen-enriched air. The copper oxide forming in the bottom metal separates out evently, owing to good mixing, to the sulfide-metal phase boundary and from this position somewhat more slowly to the sulfide melt (melt densities: >5.46/$Cu_2S$; 4.8–5.2/$Cu_2O$ and 7.85–7.95/Cu).

An oxide-sulfide conversion occurs in the sulfide melt and, correspondingly, a blister phase is formed. During the processing, the layer heights of both the sulfide matte phase and the bottom metal phase are maintained practically constant. In this example, the height of the bottom metal layer is 10 cm and that of the sulfide matte layer approx. 20 cm. Part of the sulfide matte is formed from transition matte (Table 7), the concentrations of iron and sulfur in this matte deviating from those of the feed matte. After discharge of slag from the basic smelting unit, the height of the slag layer is about 10 cm. In the course of the smelting, the height of the slag layer increases approx. 20 cm by the time of the following discharge of slag (growth period approx. 3 h). The material and thermal flow balances of conversion, corresponding to the example, are given in Table 5 and 6. The balances have been calculated per one oxidizing pipe. The pipe system used for the oxidation is the same as in the experiment series discussed above. Out of the heat loss of the total system, that corresponding to one oxidizing pipe is 200 Mcal/h.

The results corresponding to Table 6 are obtained by substituting the temperature values into the heat balance of Table 5. It can be observed from the calculated values that the heat balance of the system is realized with an oxygen enrichment corresponding to an oxygen concentration of 34.3% by weight in the air. It should be noted, however, that the necessary oxygen enrichment of the air is substantially dependent on the total heat losses of the basic smelting furnace, as well as on the temperature and composition of the phases arriving at the conversion area. The smelting conditions and the product compositions varying, the operation usually takes place at an oxygen enrichment corresponding to 30–50% by weight $O_2$ in the oxidizing air.

The conversion reactions corresponded fully to the experiment series described above. It should be noted, however, that as a result of the conversion, the slag phase, which usually contains a large amount of ferric iron, dissolves immediately in the large amount of slag in the basic smelting unit, without altering its composition to a noteworthy degree. When using the sulfide conversion according to the invention, there is thus no risk of the formation of slag phases which have high viscosity and high surface energy and are therefore disadvantageous (foaming), as in the case in conventional conversion processes.

The conversion process according to the invention does not cause great deviations as regards the behavior of the impurities of the melt phases, compared with conventional conversion. The behavior of nickel and lead in the conversion is discussed here.

Regarding nickel, the conversion reactions are as follows:

$$Ni_2S(l)+2Cu_2O(l)\rightarrow 2Ni(l)+4Cu(l)+SO_2(g) \quad (^o7)$$

$$2Ni(l)+SO_2(g)\rightarrow 2NiO(s)+\tfrac{1}{2}S_2(g) \quad (^o9)$$

At 1250° C., the equilibrium constants of the reactions are, respectively, kp=69.7 and $4.4\times10^{-2}$. In accordance with FIG. 2A, the sulfur pressure in the system is $P_{S2}+1.74\times10^{-6}$ atm. The activity coefficient of nickel in the Ni-Cu melt [Met. Trans. 4, 1973, 1723–1727] is obtained from the equation $$\gamma_{Ni}=\exp\,[(1673/T)(1-N_{Ni})^2+8.366/T]$$

The value obtained from Equilibrium Equation ($^o$9), using these values, for the concentration of nickel in the metal melt is 5.52% by weight Ni ($a_{Ni}=0.173$). At 1250° C. the equilibrium constant of reaction.

$$2Ni(l)+\tfrac{1}{2}S_2(g)Ni_2S(l) \quad (^o10)$$

is kp=668.2.

The activity coefficient of sulfide [Met. Trans., 9B, 1978, 567] in the system $Ni_2S$-$Cu_2S$ is obtained from the equation $\gamma_{Ni2S}=\exp\,[4237/T-1.382]$. By substituting into it the activity values, a value of $N_{Ni2S}=6.498\times10^{-3}$ is obtained for the concentration of $Ni_2S$ in the system. This corresponds to a value of 0.840% by weight Ni for the concentration of nickel in the sulfide melt.

Within the limits of the sulfide-metal solubility gap ($Cu/Cu_2S$), corresponding to an isobar of $P_{SO2}=1$, the copper oxidule activity corresponds to a value of $a_{Cu2O}=0.15$.

When the $a_{Ni2S}$ and $a_{Cu2O}$ values are placed in Equation ($^o$7), the value obtained for the activity of nickel in the metal phase is $a_{Ni}=0.188$, which corresponds to a nickel concentration of 6.029% by weight Ni in the metal melt. Thus the following values are obtained from Equations ($^o$7) and ($^o$8) for the nickel distribution: $\gamma_{Ni}=11.52$ and 12.57.

The distributions of nickel determined experimentally in the system Cu-$Cu_2S$ are to some extent functions of the oxygen pressure. In an equilibrium, at 1300° C., the function ($P_{SO2}$: 1.5–10 KPa), $\gamma_{Ni}=3.88\times10^{-2}\cdot P_{SO2}+2.86$ is obtained [Trans. JIM, 9. 1978, 152] for the distribution of nickel.

The $\gamma$ value was not measured at the pressure of one atmosphere, but by substituted the pressure (101 KPa) into the equation, the value $\gamma_{Ni}=6.8$ is obtained. In the conversion process corresponding to the method, the distribution of nickel was a function of the time, and thus the system was not in equilibrium. The distribution values obtained in the experiments varied within the range 2.35–1.83. The concentrations of nickel in both the bottom metal and the sulfide matte decreased as a function of the time (e.g. $Cu_2S$: 0.68–0.51% by weight Ni, Cu: 1.8–0.9% by weight Ni), which indicates continuous oxidation of nickel in accordance with Reaction ($^o$9).

The measured Nernst's distribution for lead in the metal-matte system follows the distribution of nickel (e.g. $P_{SO2}=10$ KPa, $\gamma_{Ni}=\gamma_{Pb}=3.25$). In the conversion according to the process, the concentration of lead in both phases decreased as a function of the time (e.g. $Cu_2S$: 0.20><0.1% by weight Pb, Cu: 0.50–0.12% by weight Pb). However, during the course of the conversion the distribution value of lead increased as a function of the time (e.g. $\gamma_{Pb}=3.62\rightarrow4.40$), i.e. contrary to the distribution of nickel.

TABLE 1

Free energy values of reactions $\Delta G = AxT + B\times T\times \ln T + c\times 10^{-3}T^2 + O\times 10^5T^{-1} - E$, cal/reaction

| Reaction, No. | A | B | C | D | E |
|---|---|---|---|---|---|
| Reaction: (°1) | +14.688 | +1.060 | −0.520 | +0.410 | 116727 |
| Reaction: (°2) | +41.254 | −2.340 | −0.520 | +0.410 | 88408 |
| Reaction: (°3) | −13.978 | +3.080 | −0.770 | +0.510 | 50288 |
| Reaction: (°4) | −124.441 | +13.920 | −1.270 | +0.710 | −25953 |
| Reaction: (°5) | +55.232 | −5.420 | +0.250 | −0.100 | 38120 |
| Reaction: (°6) | −26.566 | −3.400 | — | — | 28310 |
| Reaction: (°7) | −111.433 | +11.980 | −1.230 | +0.485 | −26451 |
| Reaction: (°8) | −146.619 | +15.929 | −1.393 | +0.710 | −24554 |

TABLE 2

Material and heat balance of conversion experiment series

| Balance component | Amount of material M/t, kg/min | Heat amount $\Delta H_{e+f}/t$, Mcal/min |
|---|---|---|
| Feed | | |
| Matte | 20.6595 | $2.848 \times 10^{-3}T_1 - 3.549$ |
| Bottom metal | 32.6953 | $3.859 \times 10^{-3}T_2 - 0.006$ |
| Air | 8.2332 | $1.920 \times 10^{-3}T_3 + 0.131 \times 10^{-6}T_3^2 + 0.007 \times 10^3T_3^{-1} - 0.676$ |
| Total feed | 61.5880 | $2.848 \times 10^{-3}T_1 + 3.859 \times 10^{-3}T_2 + 1.920 \times 1.920 \times 10^{-3}T_3 + 0.131 \times 10^{-6}T_3^2 + 0.007 \times 10^3T_3^{-1} - 4.232$ |
| Product | | |
| Blister | 15.6683 | $1.872 \times 10^{-3}T_2 - 0.156$ |
| Slag | 1.3660 | $0.292 \times 10^{-3}T_4 + 0.001 \times 10^{-6}T_4^2 - 1.669$ |
| Bottom metal | 32.6953 | $3.859 \times 10^{-3}T_2 - 0.006$ |
| Sulfur dioxide | 7.7417 | $1.334 \times 10^{-3}T_5 + 0.114 \times 10^{-6}T_5^2 + 0.022 \times 10^3T_5^{-1} - 9.055$ |
| Air gas | 4.1166 | $0.999 \times 10^{-3}T_5 + 0.066 \times 10^{-6}T_5^2 + 0.002 \times 10^3T_5^{-1} - 0.379$ |
| Total product | 61.5880 | $5.731 \times 10^{-3}T_2 + 0.292 \times 10^{-3}T_4 + 2.333 \times 10^{-3}T_5 + 0.001 \times 10^{-6}T_4^2 + 0.180 \times 10^{-6}T_5^2 + 0.024 \times 10^3T_5^{-1} - 11.264$ |

TABLE 3

Sub-balance of conversion experiment series. Material and heat balance of oxidation.

| Balance component | Amount of material M/t, kg/min | Heat amount $\Delta H_{e+f}/t$, Mcal/min |
|---|---|---|
| Feed | | |
| Bottom metal | 32.6953 | $3.659 \times 10^{-3}T_2 - 0.006$ |
| Air | 8.2332 | $1.920 \times 10^{-3}T_3 + 0.131 \times 10^{-6}T_3^2 + 0.007 \times 10^3T_3^{-1} - 0.676$ |
| Total feed | 40.9285 | $3.859 \times 10^{-3}T_2 + 1.920 \times 10^{-3}T_3 + 0.131 \times 10^{-6}T_3^2 + 0.007 \times 10^3T_3^{-1} - 0.682$ |
| Product | | |
| Copper oxidule | 36.8118 | $6.175 \times 10^{-3}T_6 - 10.113$ |
| Air gas | 4.1166 | $0.999 \times 10^{-3}T_5 + 0.066 \times 10^{-6}T_5^2 + 0.002 \times 10^3T_5^{-1} - 0.379$ |
| Total product | 40.9284 | $6.175 \times 10^{-3}T_6 + 0.999 \times 10^{-6}T_5 + 0.066 \times 10^{-6}T_5^2 + 0.002 \times 10^3T_5^{-1} - 10.492$ |

TABLE 4

Sub-balance of conversion experiment series. Material and heat balance of conversion.

| Balance component | Amount of material M/t, kg/min | Heat amount $\Delta H_{e+f}/t$, Mcal/min |
|---|---|---|
| Feed | | |
| Matte | 20.6595 | $2.848 \times 10^{-3}T_1 - 3.549$ |
| Copper oxidule | 36.8118 | $6.175 \times 10^{-3}T_6 - 10.113$ |
| Total feed | 57.4713 | $2.848 \times 10^{-3}T_1 + 6.175 \times 10^{-3}T_6 - 13.662$ |
| Product | | |
| Blister | 15.6683 | $1.872 \times 10^{-3}T_2 - 0.156$ |
| Slag | 1.3660 | $0.292 \times 10^{-3}T_4 + 0.001 \times 10^{-6}T_4^2 - 1.669$ |
| Bottom metal | 32.6953 | $3.859 \times 10^{-3}T_2 - 0.006$ |
| Sulfur dioxide | 7.7417 | $1.334 \times 10^{-3}T_5 + 0.114 \times 10^{-6}T_5^2 + 0.022 \times 10^3T_5^{-1} - 9.055$ |
| Total product | 57.4713 | $5.731 \times 10^{-3}T_2 + 0.292 \times 10^{-3}T_4 + 1.334 \times 10^{-3}T_5 + 0.001 \times 10^{-6}T_4^2 + 0.114 \times 10^{-6}T_4^2 + 0.022 \times 10^{-3}T_5^{-1} - 10.885$ |

TABLE 5

Conversion balance of suspension smelting. Material and heat balance of product phases.

| Balance component | Amount of material M/t, kg/min | Heat amount $\Delta H_{e+f}/t$, Mcal/min |
|---|---|---|
| Product | | |
| Stable state | $M \neq f(r)$ | |
| Total | 13950.0 | $888.434 \times 10^{-3}T_1 + 322.537 \times 10^{-3}T_2 + 1333.037 \times 10^{-3}T_4 - 9419.756$ |
| Unstable state | $M = f(t)$ | |
| Slag phase | 61.2500 | $17.010 \times 10^{-3}T_4 - 106.145$ |
| Slag phase | 1.3660 | $0.292 \times 10^{-3}T_4 + 0.001 \times 10^{-6}T_4^2 - 1.669$ |
| Blister phase | 15.6683 | $1.872 \times 10^{-3}T_2 - 0.156$ |
| Bottom metal phase | 32.6953 | $3.859 \times 10^{-3}T_2 - 0.006$ |
| Sulfur dioxide phase | 7.7417 | $1.305 \times 10^{-3}T_5 + 0.120 \times 10^{-6}T_5^2 - 9.011$ |
| Air gas phase | $4.1166 \times c$ | $0.996 \times 10^{-3}cT_5 + 0.067 \times 10^{-6}cT_5^2 - 0.375 \times c$ |
| Heat losses | — | $+ 3.333$ |

TABLE 5-continued

| | | |
|---|---|---|
| Total product | 13950.0+<br>118.7214+<br>4.1166 × c | $888.434 \times 10^{-3}T_1 + 322.537 \times 10^{-3}T_2 + 1333.037 \times 10^{-3}T_4 - 9419.756 +$<br>$t[5.731 \times 10^{-3}T_2 + 17.302 \times 10^{-3}T_4 + (1.305 + 0.996 \times c)10^{-3}T_5 +$<br>$(0.120 + 0.067 \times c)10^{-6}T_5^2 + 0.001 \times 10^{-6}T_4^2 - 113.654 - 0.375 \times c]$ |

Conversion balance of suspension smelting. Material and heat balance of feed phases.

| Balance component | Amount of material M/t, kg/min | Heat amount $\Delta H_{e+f}/t$, Mcal/min |
|---|---|---|
| Feed | | |
| Stable state | $M \neq f(t)$ | |
| Slag phase | 4800.0 | $1333.037 \times 10^{-3}T_4 - 8318.314$ |
| Matte phase | 3700.0 | $510.119 \times 10^{-3}T_1 - 635.682$ |
| Transition matte phase | 2750.0 | $378.315 \times 10^{-3}T_1 - 438.906$ |
| Bottom metal phase | 2700.0 | $322.537 \times 10^{-3}T_2 - 26.854$ |
| Total | 13950.0 | $888.434 \times 10^{-3}T_1 + 322.537 \times 10^{-3}T_2 + 1333.037 \times 10^{-3}T_4 - 9419.756$ |
| Unstable state | $M = f(t)$ | |
| Slag phase | 61.2500 | $17.010 \times 10^{-3}T_4 - 106.145$ |
| Matte phase | 20.6595 | $2.848 \times 10^{-3}T_1 - 3.549$ |
| Bottom metal phase | 32.6953 | $3.859 \times 10^{-3}T_2 - 0.006$ |
| Oxygen gas phase | 4.1166 | $0.818 \times 10^{-3}T_3 + 0.150 \times 10^{-6}T_3^2 - 0.257$ |
| Air gas phase | 4.1166 × c | $0.964 \times 10^{-3}cT_3 + 0.095 \times 10^{-6}cT_3^2 - 0.365 \times c$ |
| Total feed | 13950.0<br>118.7214+<br>4.1166 × c | $888.434 \times 10^{-3}T_1 + 322.537 \times 10^{-3}T_2 + 1333.037 \times 10^{-3}T_4 - 9419.756 +$<br>$t[2.848 \times 10^{-3}T_1 + T_1 + 3.859 \times 10^{-3}T_2 + (0.818 \times 0.964 \times c) \times 10^{-3}T_3 +$<br>$17.010 \times 10^{-3}T_1 + (0.150) + 0.095 \times c) \times 10^{-6}T_3^2 - 109.957 - 0.365 \times c]$ |

TABLE 6

Table 5
The example balance in the table comprises the conversion, in the lower furnace chamber of the basic smelting unit, of the high-grade copper sulfide matte obtained by the process according to SFP No. 52112 (USP No. 4,139,371). The balance corresponds to the following values: suspension smelting plant concentrate feed 30 t/h, lower furnace heat loss 1200 Mcal/h, and number of oxidizing-gas feed pipes in conversion 6. The balance comprises the material and heat balances calculated per one feed pipe.
Temperatures: $T_1 = 1523°$ K., $T_2 = 1473°$ K., $T_3 = 300°$ K., $T_4 = 1573°$ K., $T_5 = 1573°$ K.,
Constant coefficient: $c = (1-x)/x$; 100 x is the concentration of oxygen in oxidizing gas, % by weight $O_2$.
Sum of feed: $\Delta H_{e+f} = -9869.859 - 4.060[(1-x)/x]$, Mcal/h
Sum of product: $\Delta H_{e+f} = -10033.347 + 81.408[(1-x)/x]$, Mcal/h
The value obtained for the concentration of oxygen in the oxidizing gas is 100 x = 34.328% by weight $O_2$
The amounts of feed and product, changing as a function of the time, are $M[f(t)] = 126.5966 \times t$ kg/min
Numerical values for material and heat balances in Tables 2–5
Table 2. Total balance
Concentration of oxygen in oxidizing air is 50% by weight $O_2$
Sum of feed: $\Delta H_{e+f} = 6.402xt$, Mcal/min; M = 3965 kg/h
Sum of product: $\Delta H_{e+f} = 1.610xt$, Mcal/min
Difference: $\Delta H_{e+f} = 4.792$, Mcal/min; $\Delta H_{e+f} = 287.5$ Mcal/h
Table 3. Sub-balance: oxidation
Sum of feed: $\Delta H_{e+f} = 5.613xt$, Mcal/min; M = 2546 kg/h
Sum of product: $\Delta H_{e+f} = 0.588xt$, Mcal/min
Difference: $\Delta H_{e+f} = 5.026xt$, Mcal/min; $\Delta H_{e+f} = 301.5$ Mcal/h
Table 4.
Sum of feed: $\Delta H_{e+f} = 0.080xt$, Mcal/min; M = 3448 kg/h
Sum of product: $\Delta H_{e+f} = 0.312xt$, Mcal/min
Difference: $\Delta H_{e+f} = 0.233xt$, Mcal/min; $\Delta H_{e+f} = 14.0$ Mcal/h
Temperatures: $T_1 = 1523°$ K., $T_2 = 1473°$ K., $T_3 = 300°$ K., $T_4 = 1523°$ K., $T_5 = 1523°$ K.,

TABLE 7

Analysis of components of material balances in Tables 2–5

| | Analysis, % by weight | | | | | | |
|---|---|---|---|---|---|---|---|
| Balance component | Cu | Fe | Ni | Pb | S | O | $SiO_2$ |
| Slag-flash smelting furnace | 2.99 | 44.72 | 0.32 | — | 0.63 | 15.13 | 30.04 |
| "Slag"-converter | — | 59.93 | 2.79 | — | — | 23.40 | 7.56 |
| Matte-flash smelting furnace/converter | 74.40 | 4.00 | 0.64 | 0.17 | 19.40 | 0.47 | 0.50 |
| Transition matte-converter | 81.00 | 0.29 | 0.32 | 0.09 | 16.50 | 1.25 | 0.40 |

TABLE 7-continued

Analysis of components of material balances in Tables 2–5

| | Analysis, % by weight | | | | | | |
|---|---|---|---|---|---|---|---|
| Balance component | Cu | Fe | Ni | Pb | S | O | $SiO_2$ |
| Blister-converter | 98.10 | 0.05 | 0.60 | 0.30 | 0.85 | 0.15 | — |

What is claimed is:

1. A process for the oxidation of molten low-iron metal matte beneath a layer of slag and above a bottom layer of molten metal comprising maintaining the thickness of the bottom layer of molten metal essentially constant while blasting oxygen-enriched air into the metal layer under said matte and separating raw metal from said metal layer to maintain said essentially constant bottom layer thickness.

2. A process according to claim 1, in which the blasting is carried out substantially horizontally with a blasting pipe in such a manner that the pressure of the oxidizing gas in the blasting pipe is within the supercritical range.

3. A process according to claim 1 or 2, in which a melt is blasted which contains a minimum of 0.5% by weight iron per each cm of the matte layer in the vertical direction, in order to prevent the foaming of slag on top of the matte layer.

4. A process according to claim 1, in which oxygen-enriched air is blasted in order to control the temperature of and to refine the bottom melt.

* * * * *

UNITED STATES PATENT AND TRADEMARK OFFICE

CERTIFICATE OF CORRECTION

PATENT NO. : 4,308,058

DATED : December 29, 1981

INVENTOR(S) : Simo A.I. Makipirtti et al

It is certified that error appears in the above-identified patent and that said Letters Patent are hereby corrected as shown below:

Column 9, lines 26 and 27:

"applied in the gas pipe" should read

--applied in the gas feed pipe --.

Column 10, line 45:

"suspened" should read --suspended--.

Column 12, line 34:

"substituted" should read --substituting--.

Signed and Sealed this

*Thirteenth* Day of *April 1982*

[SEAL]

*Attest:*

GERALD J. MOSSINGHOFF

*Attesting Officer*

*Commissioner of Patents and Trademarks*